US010668718B2

(12) United States Patent
Kusumoto

(10) Patent No.: US 10,668,718 B2
(45) Date of Patent: Jun. 2, 2020

(54) INKJET RECORDING APPARATUS AND METHOD FOR CONTROLLING AN INKJET RECORDING APPARATUS

(71) Applicant: KYOCERA Document Solutions Inc., Osaka (JP)

(72) Inventor: Koji Kusumoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/444,529

(22) Filed: Jun. 18, 2019

(65) Prior Publication Data

US 2019/0389200 A1 Dec. 26, 2019

(30) Foreign Application Priority Data

Jun. 25, 2018 (JP) ..... 2018-119698

(51) Int. Cl.
*B41J 2/045* (2006.01)

(52) U.S. Cl.
CPC ..... *B41J 2/0451* (2013.01); *B41J 2/04541* (2013.01); *B41J 2/04581* (2013.01); *B41J 2/0457* (2013.01)

(58) Field of Classification Search
CPC .. B41J 2/0451; B41J 2/04541; B41J 2/04581; B41J 2/0457; B41J 2/04548
See application file for complete search history.

(56) References Cited

U.S. PATENT DOCUMENTS 8,894,171 B2 * 11/2014 Endo ..... B41J 2/04516 347/10
10,093,090 B2 * 10/2018 Yamashita ..... B41J 2/04541

FOREIGN PATENT DOCUMENTS

JP 2007-50533 A 3/2007

* cited by examiner

*Primary Examiner* — Thinh H Nguyen
(74) *Attorney, Agent, or Firm* — Stein IP, LLC

(57) ABSTRACT

An inkjet recording apparatus has a head, a first board, and a second board. The head has a plurality of nozzles and a plurality of driving elements. The first board includes a control circuit and a sensing circuit unit. The second board includes a driving voltage generator and a driver circuit. The driver circuit makes ink ejected. The driving voltage generator and the driver circuit are connected together via a first power supply line. The sensing circuit unit is connected to the first power supply line and outputs a first sensing signal. Based on the first sensing signal, the control circuit senses an abnormality in power supply on the second board.

10 Claims, 4 Drawing Sheets

INKJET RECORDING APPARATUS AND METHOD FOR CONTROLLING AN INKJET RECORDING APPARATUS

This application is based upon and claims the benefit of priority from the corresponding Japanese Patent Application No. 2018-119698 filed on Jun. 25, 2018, the entire contents of which are incorporated herein by reference.

BACKGROUND

The present disclosure relates to inkjet recording apparatuses, which perform printing by ejecting ink from nozzles.

There are some apparatuses that perform printing with ink. Such an apparatus includes a recording head. The recording head includes a plurality of nozzles. Based on image data, ink is ejected from the recording head onto a sheet. Ink is not ejected from a clogged nozzle. Printing is not performed with respect to such a part of the image data as corresponds to a nozzle that is prevented from ejecting ink. This degrades the quality of the image printed on the sheet. There are cases where nozzle clogging is monitored to prevent such inconvenience. In a known technology, clogging is detected by jetting out electrostatically charged ink from nozzles of a head.

Specifically, there is known a printing-head checking device incorporated in a printing apparatus that is provided with a printing head of which a printing distance from a support surface for supporting a print medium is adjustable, and in which ejection ports are formed through which to eject recording liquid. The printing-head checking device receives the ejected recording liquid, detects an electrical change generated when the recording liquid having been ejected in a charged state is received, detects the printing distance used for the printing, sets the ejected amount of the recording liquid based on the detected printing distance on receiving an instruction to check the printing head, causes the charged recording liquid of the set ejection amount to be ejected while maintaining the printing distance, and makes a judgment on whether or not there is an abnormality in the ejection ports based on the detected electrical change caused by the ejection. The printing-head checking device is designed to perform the checking of the printing head by consuming as small an amount of recording liquid as possible.

A head is provided with a nozzle. For the nozzle, there is provided a piezoelectric element to cause the nozzle to eject ink. When a voltage is applied to the piezoelectric element, a pressure is applied to the nozzle. This pressure causes the nozzle to eject ink.

In printing apparatuses using ink, ink ejection from a nozzle is sometimes prevented. Typically performed to address such a case is, as in the known technology mentioned above, processing of detecting nozzle clogging by ejecting ink. However, it is not just a clogged nozzle that prevents ink ejection. There is a case where the cause that is preventing ink ejection cannot be identified by such clogging detection processing. Then, it can be said that the clogging detection processing has been done in vain. In addition, since the cause remains unknown, there is a possibility that the head will be replaced although there is no abnormality in the head. Heads are generally expensive. Thus, unnecessary replacement of heads should be avoided. There is a challenge in making it possible to identify the cause of an abnormality so that unnecessary clogging detection processing or unnecessary component-replacing operations will not be performed.

It is impossible, with the known technology described above, to check an abnormality without actually ejecting ink. Thus, the challenge mentioned just above cannot be solved with the known technology.

SUMMARY

According to one aspect of the present disclosure, an inkjet recording apparatus includes a head, a first board, and a second board. The head includes a plurality of nozzles that eject ink and a plurality of driving elements that make the nozzles eject the ink. The first board includes a control circuit and a sensing circuit unit. The second board includes a driving voltage generator and a driver circuit. The driver circuit applies a driving voltage to the driving elements and thereby controls ejection of ink from the nozzles. The driving voltage generator generates the driving voltage. The driving voltage generator is connected to the driver circuit via a first power supply line. The driving voltage generator feeds the generated driving voltage to the driver circuit. The sensing circuit unit is connected to the first power supply line. The sensing circuit unit outputs a first sensing signal indicating whether or not a voltage on, and fed from, the first power supply line is equal to or lower than a first judgment value determined in advance. The control circuit is fed with the first sensing signal. Based on the first sensing signal, the control circuit senses an abnormality in power supply on the second board.

According to another aspect of the present disclosure, a method for controlling an inkjet recording apparatus includes: providing the inkjet recording apparatus with a head, a first board, and a second board; providing the head with a plurality of nozzles that eject ink and a plurality of driving elements that make the nozzles eject the ink; providing the first board with a control circuit and a sensing circuit unit; providing the second board with a driving voltage generator and a driver circuit; applying a driving voltage to the driving elements and thereby controlling ejection of ink from the nozzles by using the driver circuit; generating the driving voltage by using the driving voltage generator; connecting the driving voltage generator to the driver circuit via a first power supply line; feeding the generated driving voltage to the driver circuit; connecting the sensing circuit unit to the first power supply line; making the sensing circuit unit output a first sensing signal indicating whether or not a voltage on, and fed from, the first power supply line is equal to or lower than a first judgment value determined in advance; and sensing an abnormality in power supply on the second board based on the first sensing signal.

Further features and advantages of the present disclosure will become apparent from the description of embodiments given below.

DETAILED DESCRIPTION

The present disclosure relates to making it possible to identify the cause of an abnormality quickly, without ejecting ink. Hereinafter, with reference to FIGS. 1 to 4, an embodiment of the present disclosure will be described. As an example of an inkjet recording apparatus, a printer 100 will be dealt with in the following description. The printer 100 includes a first board 1, a second board 2, and a head 3. All the features in configuration, arrangement, and the like stated in the description of the embodiment are not in any way meant to limit the scope of the disclosure, but are merely examples presented for the sake of description.

Figure 1:
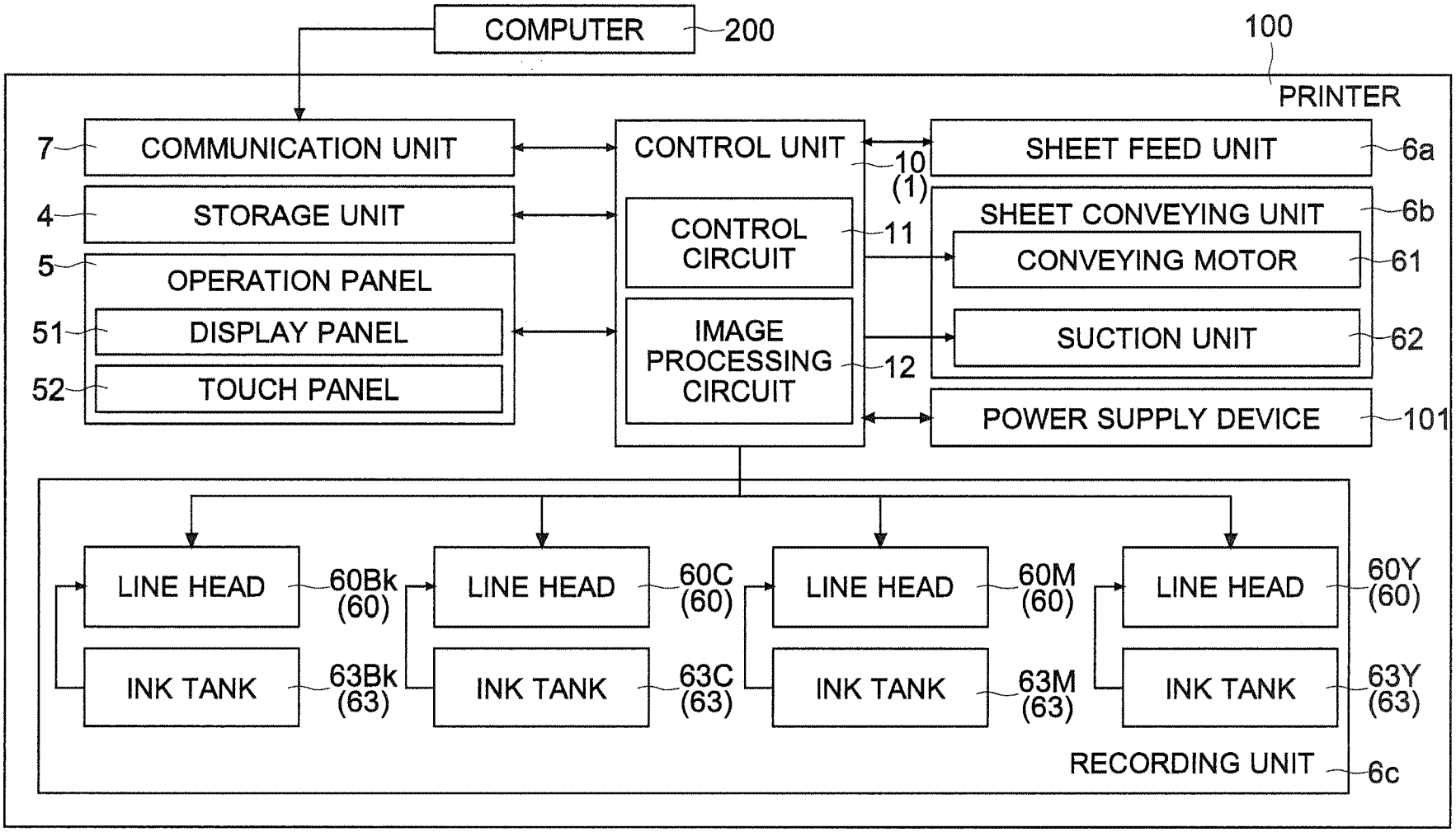
FIG. 1 is a diagram showing an example of a printer according to an embodiment.

Outline of Printer 100:

First, with reference to FIG. 1, a schematic description will be given of the printer 100 according to the embodiment. The printer 100 includes a control unit 10 (a first board 1). The control unit 10 controls each unit in the printer 100. The control unit 10 includes a control circuit 11 and an image processing circuit 12. The control circuit 11 is a CPU, for example. The control circuit 11 performs calculation and processing based on control programs and control data stored in a storage unit 4. The storage unit 4 includes a non-volatile storage device, such as a ROM, an HDD, and a flash ROM, and a volatile storage device, such as a RAM. The image processing circuit 12 performs image processing on image data. The image processing circuit 12 generates image data (print image data) to be used for printing. The print image data is data that specifies whether or not ink is to be ejected with respect to each pixel.

The printer 100 includes an operation panel 5. The operation panel 5 includes a display panel 51 and a touch panel 52. The display panel 51 displays setting screens and information. The display panel 51 displays operation images such as software keys, buttons, and tabs. The touch panel 52 senses a touch operation performed on the display panel 51. Based on the output of the touch panel 52, the control unit 10 recognizes an operation image that is operated. The control unit 10 recognizes a setting operation performed by a user.

The printer 100 includes a sheet feed unit 6*a*, a sheet conveying unit 6*b*, and a recording unit 6*c*. The sheet feed unit 6*a* stores a stack of sheets. During execution of a printing job, the control unit 10 makes the sheet feed unit 6*a* feed out a sheet. The control unit 10 makes the sheet conveying unit 6*b* convey the sheet. The sheet conveying unit 6*b* includes a conveying motor 61 and a rotation body which conveys the sheet. The control unit 10 makes the conveying motor 61 rotate. The rotation of the conveying motor 61 causes the rotation body to rotate. Thereby, the sheet fed out from the sheet feed unit 6*a* is conveyed toward a discharge tray (not shown).

The recording unit 6*c* is provided midway in a conveyance path extending from the sheet feed unit 6*a* to the discharge tray. The recording unit 6*c* is provided so as to be located above the conveyed sheet. The sheet conveying unit 6*b* includes a suction unit 62. The suction unit 62 attracts by suction the sheet passing under the recording unit 6*c*. The sucking attraction prevents positional deviation of the sheet. The control unit 10 further makes the sheet conveying unit 6*b* discharge the sheet that has undergone recording (printing) onto the discharge tray.

The recording unit 6*c* ejects ink onto the conveyed sheet to record (print) an image on it. As shown in FIG. 1, the printer 100 includes line heads 60 (60Bk, 60C, 60M, 60Y) for four colors. The line heads 60 are stationary (do not move). The line heads 60 are arranged above the conveyed sheet. The line head 60Bk ejects black ink. The line head 60C ejects cyan ink. The line head 60M ejects magenta ink. The line head 60Y ejects yellow ink.

For each line head 60, there is provided an ink tank 63 (63Bk, 63C, 63M, or 63Y) that feeds it with ink. The ink tank 63Bk stores black ink. The ink tank 63Bk feeds the line head 60Bk with the ink. The ink tank 63C stores cyan ink. The ink tank 63C feeds the line head 60C with the ink. The ink tank 63M stores magenta ink. The ink tank 63M feeds the line head 60M with the ink. The ink tank 63Y stores yellow ink. The ink tank 63Y feeds the line head 60Y with the ink.

The printer 100 includes a communication unit 7. The communication unit 7 includes communication hardware (a connector, a communication circuit) and a communication memory. The communication memory stores communication software. The communication unit 7 communicates with a computer 200. The computer 200 is a PC or a server, for example. The control unit 10 receives print data from the computer 200. The print data includes print settings and print contents. The print data includes data written in a page description language, for example. The control unit 10 (the image processing circuit 12) analyzes the received print data. Based on the received print data, the control unit 10 generates image data (raster data) to be used in image formation performed in the recording unit 6*c*. The image processing circuit 12 processes the raster data to generate print image data.

Ink Ejection Control:

Next, with reference to FIG. 2, a description will be given of one example of ink ejection control performed in the printer 100 according to the embodiment. The line head 60 for one color includes two or more (a plurality of) heads 3. In other words, the line head 60 is formed by combining a plurality of heads 3. In a direction perpendicular to a sheet conveying direction, each of the heads 3 is shorter than one line head 60. That is, the recording unit 6*c* includes a plurality of heads 3.

The heads 3 each include a plurality of nozzles 31. The nozzles 31 in each of the heads 3 are arrayed in a row. The heads 3 are each fixed such that the nozzles 31 are arranged in a row in the direction perpendicular to the sheet conveying direction. The line head 60 for one color is formed by arranging heads 3 in, for example, a staggered formation. In such a case, as seen from the sheet conveying direction, the heads 3 include a fore-row head 3 and a hind-row head 3. Part of an end portion of the fore-row head 3 and part of an end portion of the hind-row head 3 overlap each other as seen from the sheet conveying direction.

Figure 2:
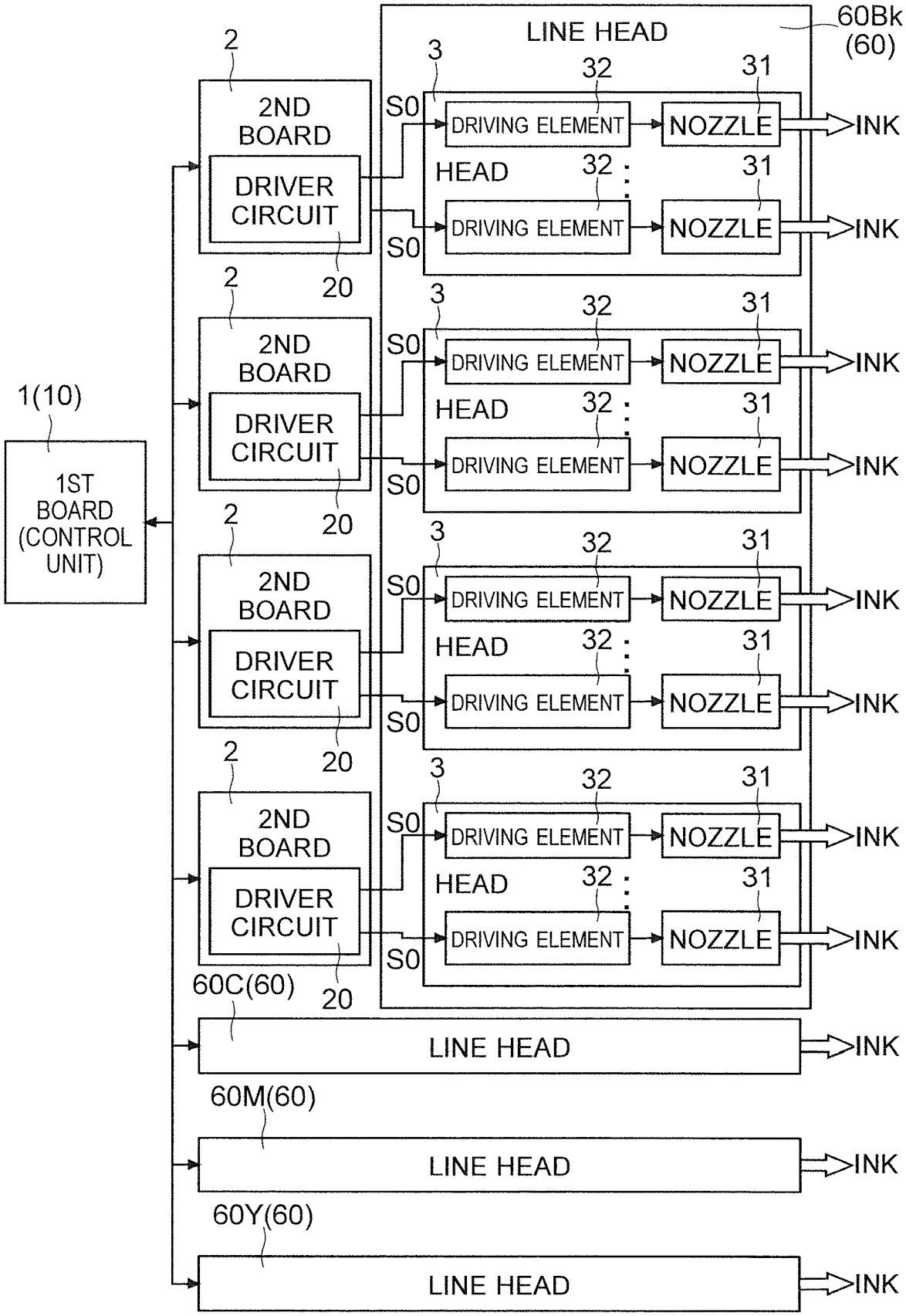
FIG. 2 is a diagram showing an example of how ink ejection is controlled in the printer according to the embodiment.

As shown in FIG. 2, the heads 3 each include a plurality of nozzles 31. The nozzles 31 are formed, for example, by etching, perforating a metal sheet, or otherwise. The nozzles 31 are formed at uniform intervals in the main scanning direction. The openings of these nozzles 31 face a conveyed sheet. For one nozzle 31, one driving element 32 is provided. The driving element 32 is a piezoelectric element. Thus, the heads 3 are each provided with a plurality of nozzles 31, which eject ink, and a plurality of driving elements 32, which make the nozzles 31 eject ink.

For one head 3 or a plurality of heads 3, one second board 2 is provided. FIG. 2 shows an example where one second board 2 is provided for one head 3. One second board 2 may control a plurality of heads 3 instead. The second boards 2 are each provided with a driver circuit 20 (see FIG. 3). The driver circuits 20 feed an ejection signal S0 to the driving elements 32 corresponding to the nozzles 31 from which ink is to be ejected. The ejection signal S0 has a waveform of a pulse signal. The amplitude of the ejection signal equals a driving voltage V1. Thus, the driver circuits 20 apply the driving voltage V1 to the driving elements 32. By the application of the driving voltage V1, the driver circuits 20 control ejection of ink from the nozzles 31. The driving elements 32 are deformed when a voltage is applied to them. Consequently, pressure resulting from the deformation is applied to the nozzles 31 and to the flow passages through which ink is fed to the nozzles 31. The pressure causes ink to be ejected out of the nozzles 31. The ejected ink reaches the conveyed sheet. Thereby, an image is recorded (formed). The nozzles 31 are arrayed in a direction (the main scanning direction) perpendicular to the sheet conveying direction. The interval between the nozzles 31 in the main scanning direction is equal to the pixel-to-pixel pitch.

During printing, the control unit 10 (the control circuit 11, the image processing circuit 12) makes the driver circuits 20 execute ink ejection from the nozzles 31. On the other hand, the control unit 10 does not make the driver circuits 20 apply the driving voltage V1 to the driving elements 32 corresponding to the pixels with respect to which no ink is to be ejected. The control unit 10 (the image processing circuit 12) generates print image data for each line head 60 (that is, for each color). The control unit 10 transmits the generated print image data to the heads 3. The image data transmitted from the control unit 10 to the driver circuits 20 is data (binary data) that specifies, with respect to each pixel and each line, whether or not to eject ink. The control unit 10 (the image processing circuit 12) transmits the image data, on a line-by-line basis in the main scanning direction, to the driver circuits 20.

Based on the print image data, the driver circuits 20 feed the ejection signal S0 to the driving elements 32 corresponding to the nozzles 31 from which ink is to be ejected. For the sake of convenience, FIG. 2 shows part of the interior of only one line head 60Bk of the plurality of line heads 60. The line heads 60 for the other colors each have a configuration similar to the line head 60Bk.

The control unit 10 may feed the driver circuits 20 with a clock signal. Based on the clock signal, the period (the frequency) of ink ejection is determined. During the execution of a printing job, the period of the ejection signal S0 which the driver circuits 20 feed to the driving elements 32 (that is, the period at which the driving voltage V1 is applied) is constant. A sheet is conveyed at a speed such that a sheet moves by one dot (one line) per period of ink ejection. The control unit 10 makes the sheet conveying unit 6*b* convey a sheet at a predetermined sheet conveying speed. Based on the image data, the driver circuits 20 apply a voltage to the driving elements 32 corresponding to the pixels (the nozzles 31) with respect to which ink is to be ejected. This processing is repeated from top to bottom of a page in the sheet conveying direction (a sub-scanning direction), and as a result, one page is printed.

First Board 1 and Second Board 2:

Next, with reference to FIG. 3, a description will be given of the first board 1 and the second board 2 according to the embodiment. The printer 100 includes a head 3, a first board 1, and a second board 2. The first board 1 is, for example, the control unit 10. On the other hand, the second board 2 may be provided one for one head 3 or one for a plurality of heads 3. In the printer 100, a plurality of second boards 2 are actually provided. For the sake of convenience, in FIG. 3, just one second board 2 is illustrated. The second boards 2 are all connected to the first board 1.

Figure 3:
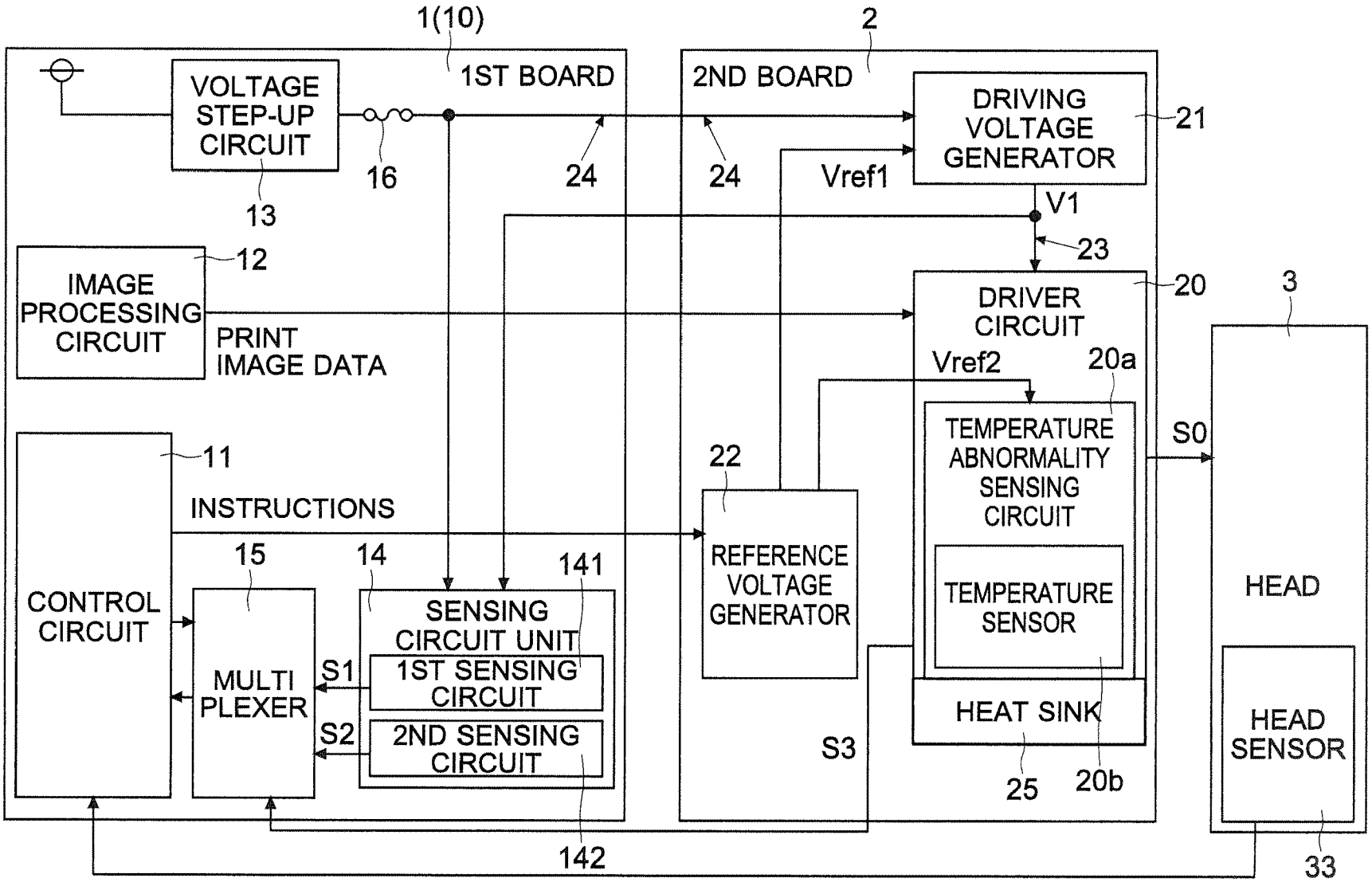
FIG. 3 is a diagram showing an example of a first board and a second board according to the embodiment.

As shown in FIG. 3, the first board 1 includes the control circuit 11 and the image processing circuit 12. The first board 1 further includes a voltage step-up circuit 13, a sensing circuit unit 14, and a multiplexer 15. On the other hand, the second board 2 includes the driver circuit 20, a driving voltage generator 21, and a reference voltage generator 22.

The driving voltage generator 21 generates the driving voltage V1. The driving voltage generator 21 is connected to the driver circuit 20 via a first power supply line 23. The driving voltage generator 21 feeds the generated driving voltage V1 to the driver circuit 20. The driving voltage V1 is a direct-current (DC) voltage. The driver circuit 20 uses the fed driving voltage V1 to feed the ejection signal S0 to the driving elements 32.

The voltage step-up circuit 13 is connected to the driving voltage generator 21 via a second power supply line 24. The voltage step-up circuit 13 is supplied with power from a power supply device 101. The printer 100 includes the power supply device 101 (see FIG. 1). The power supply device 101 is supplied with power from a commercial power supply (via a receptacle outlet). The power supply device 101 converts an alternate-current (AC) voltage to generate a DC voltage. For example, the power supply device 101 includes a switching power supply. The switching power supply generates a DC voltage, and the DC voltage is fed to the voltage step-up circuit 13.

The voltage step-up circuit 13 feeds a stepped-up voltage to the driving voltage generator 21 via the second power supply line 24. The driving voltage generator 21 generates the driving voltage V1 based on the output voltage of the voltage step-up circuit 13. For example, the driving voltage generator 21 generates the driving voltage V1 of several tens of volts. For example, the driving voltage generator 21 generates, as the driving voltage V1, a DC voltage of about 30 V to 40 V.

The second power supply line 24 is provided with a fuse 16. The fuse 16 is provided between the voltage step-up circuit 13 and the driving voltage generator 21 on the first board 1. When the current passing through the fuse 16 exceeds the permissible current, the fuse 16 blows out. The fuse 16 prevents a high current from passing into the driving voltage generator 21 from the voltage step-up circuit 13. The fuse 16 protects the voltage step-up circuit 13 and the driving voltage generator 21 against overcurrent.

The first board 1 (the control unit 10) is provided, in the printer 100, at a position near an exterior cover. This arrangement facilitates the replacement of the first board 1. On the other hand, the second board 2 is provided near the head 3. The head 3 is provided near the middle (the center) of the printer 100. Hence, the second power supply line 24 (a conductor) connecting the first board 1 and the second board 2 to each other is laid so as to circumvent the members inside the printer 100.

The reference voltage generator 22 generates a first reference voltage Vref1 and a second reference voltage Vref2 based on instructions from the control circuit 11. The reference voltage generator 22 includes a plurality of D/A converters, for example. The control circuit 11 specifies the magnitudes of the first reference voltage Vref1 and the second reference voltage Vref2. The reference voltage generator 22 generates the first reference voltage Vref1 and the second reference voltage Vref2 having the specified magnitudes.

The first reference voltage Vref1 is fed to the driving voltage generator 21. The first reference voltage Vref1 is a signal that specifies the magnitude of the driving voltage V1 to be generated. The driving voltage generator 21 changes the magnitude of the generated driving voltage V1 in accordance with the magnitude of the first reference voltage Vref1. For example, the larger the first reference voltage Vref1 is, the larger driving voltage V1 the driving voltage generator 21 generates. The smaller the first reference voltage Vref1 is, the smaller driving voltage V1 the driving voltage generator 21 generates.

Here, the head 3 includes a head sensor 33. The head sensor 33 is a temperature sensor. The output of the head sensor 33 is fed to the control circuit 11. The control circuit 11 senses the temperature of the head 3 based on the output of the head sensor 33. The control circuit 11 changes the magnitude of the first reference voltage Vref1 in accordance with the temperature of the head 3. The control circuit 11 controls the magnitude of the first reference voltage Vref1 such that the higher the temperature of the head 3 is, the lower the driving voltage V1 is made. The control circuit 11 controls the magnitude of the first reference voltage Vref1 such that the lower the temperature of the head 3 is, the higher the driving voltage V1 made. The viscosity of ink depends on temperature. The higher the temperature is, the lower the viscosity of ink is. The lower the temperature is, the higher the viscosity of ink is. Thus, the control circuit 11 makes the driving voltage V1 higher when the temperature of ink is low than when the temperature of ink is high.

Next, a description will be given of how an abnormality in power supply on the second board 2 is sensed. The sensing circuit unit 14 is connected to the first power supply line 23. The voltage on the first power supply line 23 is fed to the sensing circuit unit 14. In other words, the output of the driving voltage generator 21 is fed to the sensing circuit unit 14. The sensing circuit unit 14 includes a first sensing circuit 141. The first sensing circuit 141 senses that the voltage (the driving voltage V1) on the first power supply line 23 has become equal to or lower than a first judgment value which has been determined in advance. The first judgment value is smaller than a minimum value of the driving voltage V1 which the driving voltage generator 21 generates when it is in operation. In other words, the first judgment value is smaller than the minimum value of the driving voltage V1 stated in the specifications. For example, the first judgment value can be set at a value that is equal to or smaller than half the minimum value.

The first sensing circuit 141 outputs a first sensing signal S1. When the voltage on the first power supply line 23 is equal to or lower than the first judgment value, the first sensing signal S1 output from the first sensing circuit 141 is at High level. When the voltage on the first power supply line 23 is higher than the first judgment value, the first sensing signal S1 output from the first sensing circuit 141 is at Low level. The first sensing signal S1 output from the first sensing circuit 141 may be at Low level when the voltage on the first power supply line 23 is equal to or lower than the first judgment value. In such a case, when the voltage on the first power supply line 23 is higher than the first judgment value, the first sensing signal S1 output from the first sensing circuit 141 is at High level.

For example, the first sensing circuit 141 includes a first voltage generation circuit and a first comparison circuit. The first voltage generation circuit generates the voltage having a value equal to the first judgment value. The first comparison circuit compares the voltage having a value equal to the first judgment value with the voltage on the first power supply line 23. The output of the first comparison circuit serves as the first sensing signal S1.

The first sensing signal S1 is fed to the multiplexer 15. Via the multiplexer 15, the first sensing signal S1 is fed to the control circuit 11. The control circuit 11 is capable of recognizing the level of the first sensing signal S1. When the level of the first sensing signal S1 during the operation period of the driving voltage generator 21 is a level indicating that the voltage on the first power supply line 23 is equal to or lower than the first judgment value, the control circuit 11 judges that there is an abnormality in the power supply in the second board 2. In other words, the control circuit 11 judges that an abnormal driving voltage V1 is generated by the driving voltage generator 21. When the driving voltage V1 is too low, or when it is zero, it is impossible to deform the driving element 32 to an extent sufficient to eject ink. As a cause preventing ink ejection, the presence of an abnormality in a circuit included in the second board 2 can be identified.

Next, a description will be given of how an abnormality in the power supply from the first board 1 to the second board 2 is sensed. The sensing circuit unit 14 is connected to the second power supply line 24. The voltage on the second power supply line 24 is fed to the sensing circuit unit 14. In other words, the output of the voltage step-up circuit 13 is fed to the sensing circuit unit 14. The voltage between the fuse 16 and the driving voltage generator 21 is fed to the sensing circuit unit 14.

The sensing circuit unit 14 includes a second sensing circuit 142. The second sensing circuit 142 senses that the voltage on the second power supply line 24 (that is, the output voltage of the voltage step-up circuit 13) has become equal to or lower than a second judgment value which has been determined in advance. The second judgment value can be set, for example, at a value that is sufficiently smaller than the rated output voltage of the voltage step-up circuit 13. For example, the second judgment value can be set at a value that is equal to or smaller than half the rated output voltage of the voltage step-up circuit 13.

The second sensing circuit 142 outputs a second sensing signal S2. When the voltage on the second power supply line 24 is equal to or lower than the second judgment value, the second sensing signal S2 output from the second sensing circuit 142 is at High level. When the voltage on the second power supply line 24 is higher than the second judgment value, the second sensing signal S2 output from the second sensing circuit 142 is at Low level. The second sensing signal S2 output from the second sensing circuit 142 may be at Low level when the voltage on the second power supply line 24 is equal to or lower than the second judgment value. In such a case, when the voltage on the second power supply line 24 is higher than the second judgment value, the second sensing signal S2 output from the second sensing circuit 142 is at High level.

For example, the second sensing circuit 142 includes a second voltage generation circuit and a second comparison circuit. The second voltage generation circuit generates a voltage having a value equal to the second judgment value. The second comparison circuit compares the voltage having a value equal to the second judgment value with the voltage on the second power supply line 24. The output of the second comparison circuit serves as the second sensing signal S2.

The second sensing signal S2 is fed to the multiplexer 15. Via the multiplexer 15, the second sensing signal S2 is fed to the control circuit 11. The control circuit 11 is capable of recognizing the level of the second sensing signal S2. When the level of the second sensing signal S2 during a period in which the voltage step-up circuit 13 is made to output the rated output voltage is a level indicating that the voltage on the second power supply line 24 is equal to or lower than the second judgment value, the control circuit 11 judges that there is an abnormality in the power supply from the first board 1 to the second board 2. In other words, the control circuit 11 judges that there is an abnormality in the supply of the voltage generated by the voltage step-up circuit 13. As a cause preventing ink ejection, the presence of an abnormality in the power supply from the first board 1 to the second board 2 can be identified.

Next, a description will be given of how an abnormality in the driver circuit 20 is sensed. For ink ejection, the driver circuit 20 turns on/off the application of voltage to the driving elements 32. The driver circuit 20 applies a voltage of several tens of volts (for example, about 30 V) to the driving element 32. The driver circuit 20 deals with a comparatively high voltage. Heat generated in the driver circuit 20 cannot be ignored. Too high a temperature can cause an abnormality in the driver circuit 20, and can even prevent the proper ejection of ink.

Thus, it is necessary to dissipate heat from the driver circuit 20. For heat dissipation, the driver circuit 20 is connected to a heat sink 25. To the driver circuit 20, the heat sink 25 is attached. In a case where the heat sink 25 is properly attached to the driver circuit 20, the driver circuit 20 and the heat sink 25 are in contact with each other over an area that is equal to or larger than a given area. In such a case, heat is dissipated via the heat sink 25, so that the temperature of the driver circuit 20 is maintained within the operation guaranteed temperature range. However, there is a case where, in the process of manufacture, a gap is unintentionally formed between the driver circuit 20 and the heat sink 25. There is also a case where a gap develops between the driver circuit 20 and the heat sink 25 with time of use. Thus, there are cases where the contact area over which the driver circuit 20 and the heat sink 25 are in contact with each other is not sufficiently large. In such cases, the heat dissipation performance is degraded. The degraded heat dissipation performance sometimes causes an excessive rise of temperature in the driver circuit 20.

To sense an abnormal rise of temperature in the driver circuit 20, as shown in FIG. 3, the driver circuit 20 includes a temperature abnormality sensing circuit 20*a*. The temperature abnormality sensing circuit 20*a* includes a temperature sensor 20*b*. The temperature abnormality sensing circuit 20*a* may further include a comparison circuit. The temperature abnormality sensing circuit 20*a* compares the second reference voltage Vref2 with the output of the temperature sensor 20*b*, and judges whether or not the temperature of the driver circuit 20 is equal to or higher than a reference temperature. Thus, the reference temperature is determined based on the magnitude of the second reference voltage Vref2. For example, the reference temperature is set at any temperature (for example, 120° C.) in the range of 100 to 150° C. The second reference voltage Vref2 can have the same voltage value as the output value of the temperature sensor 20*b* that is output at the reference temperature.

The driver circuit 20 (the temperature abnormality sensing circuit 20*a*) outputs a temperature abnormality sensing signal S3. When it has been judged that the temperature of the driver circuit 20 is equal to or higher than the reference temperature, the temperature abnormality sensing circuit 20*a* makes the level of the temperature abnormality sensing signal S3 a level (for example, High level) that indicates a temperature abnormality. The temperature abnormality sensing signal S3 is fed to the multiplexer 15. Via the multiplexer 15, the temperature abnormality sensing signal S3 is fed to the control circuit 11. The control circuit 11 is capable of recognizing the level of the temperature abnormality sensing signal S3. When the level of the temperature abnormality sensing signal S3 is a level that indicates a temperature abnormality, the control circuit 11 judges that there is an abnormality in the driver circuit 20. In other words, the control circuit 11 judges that there is a gap (detachment) between the driver circuit 20 and the heat sink 25. As a cause preventing ink ejection, the presence of an abnormality in the driver circuit 20 can be identified.

Next, a description will be given of how an abnormality in the temperature abnormality sensing circuit 20*a* of the driver circuit 20 is sensed. When there is an abnormality in the temperature abnormality sensing circuit 20*a*, it is impossible to correctly sense a temperature abnormality in the driver circuit 20. Thus, within an abnormality sensing period, which is determined in advance, the control circuit 11 sets the second reference voltage Vref2 at a first voltage value. Outside the abnormality sensing period, the second reference voltage Vref2 is set at a second voltage value.

The first voltage value is a voltage value such that the reference temperature that is determined based on the first voltage value is lower than the reference temperature that is determined based on the second voltage value. For example, the first voltage value can be the output voltage value of the temperature sensor 20*b* in a case where the temperature of the driver circuit 20 is equal to a room temperature (any temperature between 10° C. and 25° C.) or lower than the room temperature. The second voltage value can be the output voltage value of the temperature sensor 20*b* in a case where the temperature of the driver circuit 20 is equal to the maximum temperature in the operation guaranteed temperature range.

In the case where the second reference voltage Vref2 is set at the first voltage value, when the level of the temperature abnormality sensing signal S3 is a level that indicates a temperature abnormality, the control circuit 11 judges that there is no abnormality in the temperature abnormality sensing circuit 20*a*. The control circuit 11 judges that the temperature abnormality sensing circuit 20*a* is functioning properly. On the other hand, if the level of the temperature abnormality sensing signal S3 does not become a level that indicates a temperature abnormality, though the reference voltage has been set at the first voltage value, the control circuit 11 judges that there is an abnormality in the temperature abnormality sensing circuit 20*a*. The control circuit 11 senses an abnormality that the temperature abnormality sensing circuit 20*a* is not functioning.

Abnormality Sensing Procedure:

Next, with reference to FIG. 4, a description will be given of one example of the flow of an abnormality sensing procedure on the printer 100 according to the embodiment. The flow of FIG. 4 starts when an abnormality sensing period starts. The start time point of the abnormality sensing period is determined in advance. At the start time point of the abnormality sensing period, the voltage step-up circuit 13 is outputting the stepped-up voltage, and the driving voltage generator 21 is generating the driving voltage V1. The start time point of the abnormality sensing period may be the time point when the main power is turned on and the printer 100 is started up. The start time point of the abnormality sensing period may be a time point after the start-up until a printing job is started. The start time point of the abnormality sensing period may be when the printer 100 starts up by recovery from a power-saving mode. The start time point of the abnormality sensing period may be the time point when a printing job is complete.

Figure 4:
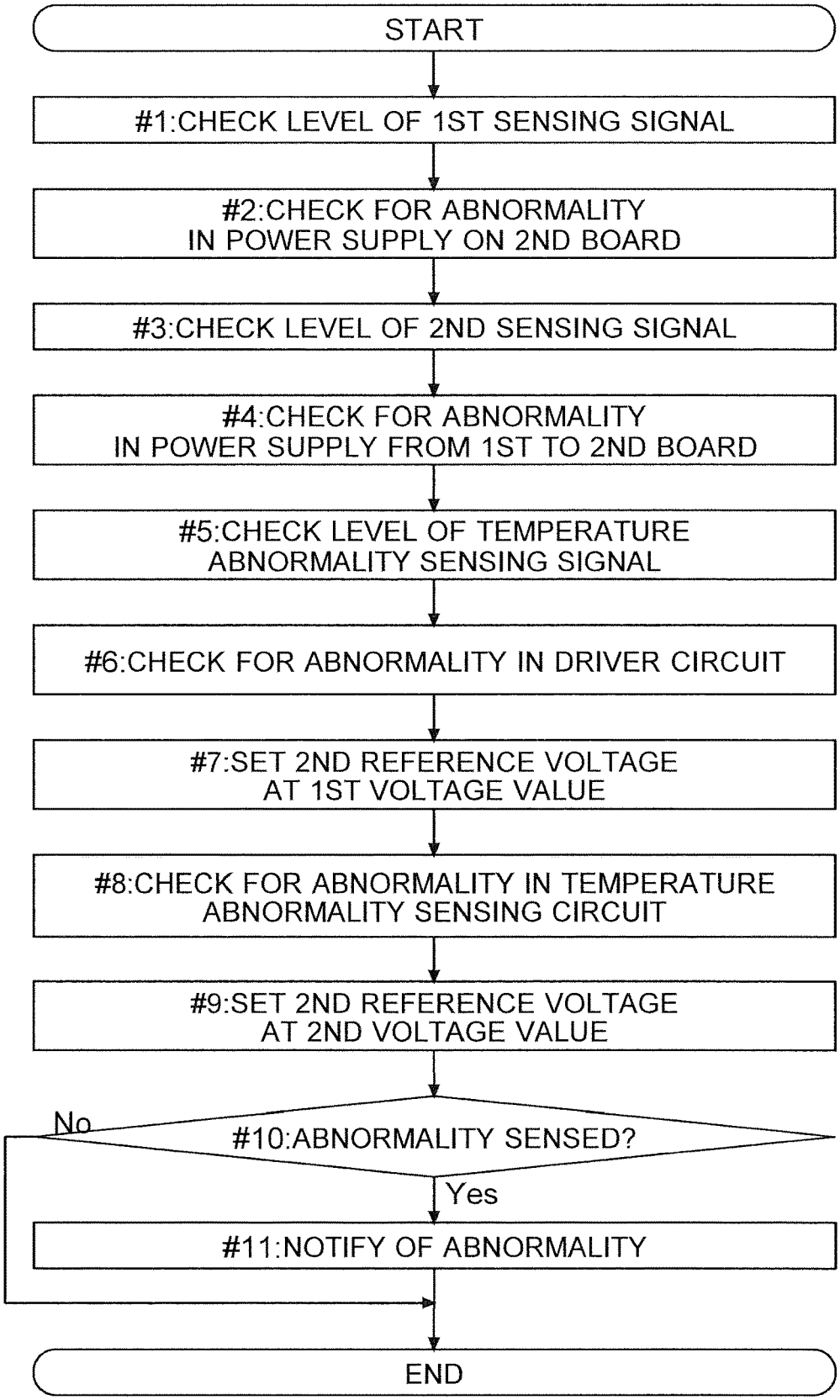
FIG. 4 is a diagram showing an example of the flow of an abnormality sensing procedure performed in the printer according to the embodiment.

The flow chart of FIG. 4 is performed for each second board 2. After the start of the abnormality sensing period, the abnormality sensing procedure is performed with respect to the second board 2 which is in the first position in order. When the abnormality sensing procedure ends, the abnormality sensing procedure is repeated for the other second boards 2, up through the one in the last position in order.

First, the control circuit 11 checks the level of the first sensing signal S1 (step #1). In this case, the control circuit 11 makes the multiplexer 15 output the first sensing signal S1. The control circuit 11 selects the signal which it makes the multiplexer 15 output. The control circuit 11 feeds the multiplexer 15 with a selection signal based on which to select a signal (the same applies throughout the following description). Next, based on the output level of the first sensing signal S1, the control circuit 11 checks whether or not there is an abnormality in power supply on the second board 2 (step #2).

Next, the control circuit 11 checks the level of the second sensing signal S2 (step #3). In this case, the control circuit 11 makes the multiplexer 15 output the second sensing signal S2. Next, based on the output level of the second sensing signal S2, the control circuit 11 checks whether or not there is an abnormality in power supply from the first board 1 to the second board 2 (step #4).

Next, the control circuit 11 checks the level of the temperature abnormality sensing signal S3 (step #5). In this case, the control circuit 11 makes the multiplexer 15 output the temperature abnormality sensing signal S3. Next, based on the output level of the temperature abnormality sensing signal S3, the control circuit 11 checks whether or not there is an abnormality in the driver circuit 20 (step #6).

The control circuit 11 sets the second reference voltage Vref2 at the first voltage value (step #7). Incidentally, outside the abnormality sensing period, the control circuit 11 sets the second reference voltage Vref2 at the second voltage value. Next, based on whether or not the level of the temperature abnormality sensing signal S3 is a level that indicates a temperature abnormality, the control circuit 11 checks whether or not there is an abnormality in the temperature abnormality sensing circuit 20*a* (step #8). Thereafter, the control circuit 11 sets the second reference voltage Vref2 at the second voltage value (step #9).

The control circuit 11 determines whether or not any abnormality has been sensed (step #10). When no abnormality at all has been sensed ("No" at step #10), the flow ends. When any abnormality has been sensed, the control circuit 11 notifies of the sensed abnormality (step #11). Then, the flow ends ("END").

Using the display panel 51, the control circuit 11 gives notifications by display. When an abnormality in power supply on a second board 2 is sensed, the control circuit 11 makes the display panel 51 notify of the abnormality in power supply on the second board 2 or an abnormality in the driving voltage generator 21. When an abnormality in power supply from the first board 1 to a second board 2 is sensed, the control circuit 11 makes the display panel 51 notify of the abnormality in the power supply path from the first board 1 to the second board 2. When an abnormality in the driver circuit 20 is sensed, the control circuit 11 makes the display panel 51 notify of the abnormality in the driver circuit 20 or insufficient contact of the driver circuit 20 with the heat sink 25. When an abnormality in the temperature abnormality sensing circuit 20*a* is sensed, the control circuit 11 makes the display panel 51 notify of the abnormality in the temperature abnormality sensing circuit 20*a*.

The control circuit 11 may give those notifications by using the communication unit 7. In that case, the control circuit 11 makes the communication unit 7 transmit data indicating the abnormal location (identified abnormality) toward a computer 200 determined in advance. The computer 200 so notified can be a PC of the administrator of the printer 100 or a server for customer contact at the maintenance company for the printer 100. On receiving the notification, the computer 200 displays on a display the abnormality of which it has been notified.

As described above, a printer 100 (inkjet recording apparatus) according to an embodiment includes a head 3, a first board 1, and a second board 2. The head 3 includes a plurality of nozzles 31 that eject ink and a plurality of driving elements 32 that make the nozzles 31 eject the ink. The first board 1 includes a control circuit 11 and a sensing circuit unit 14. The second board 2 includes a driving voltage generator 21 and a driver circuit 20. The driver circuit 20 applies a driving voltage V1 to the driving elements 32 and thereby controls ejection of ink from the nozzles 31. The driving voltage generator 21 generates the driving voltage V1. The driving voltage generator 21 is connected to the driver circuit 20 via a first power supply line 23. The driving voltage generator 21 feeds the generated driving voltage V1 to the driver circuit 20. The sensing circuit unit 14 is connected to the first power supply line 23. The sensing circuit unit 14 outputs a first sensing signal S1 indicating whether or not the voltage on, and fed from, the first power supply line 23 is equal to or lower than a first judgment value determined in advance. The control circuit 11 is fed with the first sensing signal S1. Based on the first sensing signal S1, the control circuit 11 senses an abnormality in power supply on the second board 2. It is possible to sense an abnormality in power supply from the driving voltage generator 21 to the driver circuit 20 on the second board 2. In other words, it is possible to sense an abnormality in the power source provided on the second board 2. It is possible to identify the cause of an abnormality quickly.

The first board 1 includes a voltage step-up circuit 13. The voltage step-up circuit 13 is connected to the driving voltage generator 21 via a second power supply line 24. The step-up circuit 13 feeds a stepped-up voltage to the driving voltage generator 21. The driving voltage generator 21 generates the driving voltage V1 based on the output voltage of the voltage step-up circuit 13. The sensing circuit unit 14 is connected to the second power supply line 24. The sensing circuit unit 14 outputs a second sensing signal S2 indicating whether or not the voltage on, and fed from, the second power supply line 24 is equal to or lower than a second judgment value determined in advance. The control circuit 11 is fed with the second sensing signal S2. Based on the second sensing signal S2, the control circuit 11 senses an abnormality in power supply from the first board 1 to the second board 2. It is possible to sense an abnormality in the power supply path from the step-up circuit 13 on the first board 1 to the driving voltage generator 21 on the second board 2. In other words, it is possible to sense an abnormality in the power source on the first board 1 that feeds the second board 2 with electric power. It is possible to identify the cause of an abnormality quickly.

A fuse 16 is provided between the voltage step-up circuit 13 and the driving voltage generator 21, on the first board 1. The voltage between the fuse 16 and the driving voltage generator 21 is fed, as the voltage on the second power supply line 24, to the sensing circuit unit 14. By providing a fuse 16 in the second power supply line 24, it is possible to prevent an overcurrent from passing from the first board 1 to the second board 2. With a blown-out fuse, it is possible to sense suspension of power supply from the step-up circuit 13 on the first board 1 to the driving voltage generator 21 on the second board 2.

The inkjet recording apparatus further includes a heat sink 25 attached to the driver circuit 20. The driver circuit 20 includes a temperature abnormality sensing circuit 20*a*. The temperature abnormality sensing circuit 20*a* outputs a temperature abnormality sensing signal S3. The temperature abnormality sensing circuit 20*a* sets the level of the temperature abnormality sensing signal S3 at a level indicating a temperature abnormality when the temperature of the driver circuit 20 is judged to be equal to or higher than a reference temperature. The control circuit 11 is fed with the temperature abnormality sensing signal S3. The control circuit 11 senses an abnormality in the driver circuit 20 based on the level of the temperature abnormality sensing signal S3. It is possible to sense an excessive rise in temperature in the driver circuit 20. It is possible to sense an abnormality of the heat sink 25 not being attached to the driver circuit 20 properly.

The inkjet recording apparatus further includes a reference voltage generator 22 that generates a first reference voltage Vref1 based on an instruction from the control circuit 11. The driving voltage generator 21 is fed with the first reference voltage Vref1. The driving voltage generator 21 changes the magnitude of the generated driving voltage V1 in accordance with the magnitude of the first reference voltage Vref1. It is possible to adjust the magnitude of the voltage (driving voltage V1) that is fed to the driving elements 32 in the head 3.

The head 3 of the inkjet recording apparatus includes a head sensor 33 that senses the temperature of the head 3. The output of the head sensor 33 is fed to the control circuit 11. Based on the output of the head sensor 33, the control circuit 11 senses the temperature of the head 3. The control circuit 11 changes the magnitude of the first reference voltage Vref1 in accordance with the temperature of the head 3. The control circuit 11 decreases the driving voltage V1 as the temperature of the head 3 becomes higher. The control circuit 11 increases the driving voltage V1 as the temperature of the head 3 becomes lower. It is possible to generate the driving voltage V1 that suits the viscosity of ink, which changes with temperature. When temperature is low and viscosity is high, the driving voltage V1 can be increased. As temperature rises and viscosity lowers, the driving voltage V1 can be reduced. By adjusting the driving voltage V1 in accordance with the viscosity of ink, it is possible to keep constant the amount of ink ejected from the nozzles 31.

The inkjet recording apparatus further includes a reference voltage generator 22 that generates a second reference voltage Vref2 based on an instruction from the control circuit 11. The reference voltage generator 22 feeds the generated second reference voltage Vref2 to the temperature abnormality sensing circuit 20*a*. The temperature abnormality sensing circuit 20*a* sets the level of the temperature abnormality sensing signal S3 at the level indicating a temperature abnormality when the temperature of the driver circuit 20 is judged to be equal to or higher than the reference temperature, which is determined based on the magnitude of the second reference voltage Vref2. The control circuit 11 keeps the second reference voltage Vref2 at a first voltage value during an abnormality sensing period determined in advance. The control circuit 11 keeps the second reference voltage Vref2 at a second voltage value outside the abnormality sensing period. The control circuit 11 judges that the temperature abnormality sensing circuit 20*a* is normal if, when the second reference voltage Vref2 is set at the first voltage value, the level of the temperature abnormality sensing signal S3 turns to the level indicating a temperature abnormality. The control circuit 11 judges that the temperature abnormality sensing circuit 20*a* is abnormal if, even when the second reference voltage Vref2 is set at the first voltage value, the level of the temperature abnormality sensing signal S3 does not turn to the level indicating a temperature abnormality. The first voltage value is a voltage such that the reference temperature that is determined based on the first voltage value is lower than the reference temperature that is determined based on the second voltage value. It is possible to recognize whether or not there is an abnormality in the temperature abnormality sensing circuit 20*a*. It is possible to judge whether or not an important circuit in the driver circuit 20 which controls ink ejection is normal.

The inkjet recording apparatus includes a plurality of the heads 3. There are provided a plurality of the second boards 2. The control circuit 11 senses an abnormality in power supply on the second boards 2 for each of the second boards 2 individually. It is possible to quickly sense an abnormality on a particular one of the second boards 2 provided for the heads 3 respectively.

While an embodiment of the present disclosure has been described, it is in no way meant to limit the scope of the present disclosure; the present disclosure can be implemented with any modifications made within the spirit of the present disclosure. For example, the control circuit 11 may check the levels of the first sensing signal S1, the second sensing signal S2, and the temperature abnormality sensing signal S3 from the second board 2 outside the abnormality sensing period. The control circuit 11 may check the levels of the first sensing signal S1, the second sensing signal S2, and the temperature abnormality sensing signal S3 periodically. The control circuit 11 may check, even outside the abnormality sensing period, whether or not there is an abnormality in power supply on the second board 2, whether or not there is an abnormality in power supply from the first board 1 to the second board 2, and whether or not there is an abnormality in the driver circuit 20.

The present disclosure is applicable to inkjet recording apparatuses that perform printing by use of ink.

What is claimed is:

1. An inkjet recording apparatus comprising a head, a first board, and a second board, wherein the head includes a plurality of nozzles that eject ink and a plurality of driving elements that make the nozzles eject the ink, the first board includes a control circuit and a sensing circuit unit, the second board includes a driving voltage generator and a driver circuit, the driver circuit applies a driving voltage to the driving elements and thereby controls ejection of the ink from the nozzles, the driving voltage generator generates the driving voltage, is connected to the driver circuit via a first power supply line, and feeds the generated driving voltage to the driver circuit, the sensing circuit unit is connected to the first power supply line and outputs a first sensing signal indicating whether or not a voltage on, and fed from, the first power supply line is equal to or lower than a first judgment value determined in advance, and the control circuit is fed with the first sensing signal and senses an abnormality in power supply on the second board based on the first sensing signal.

2. The inkjet recording apparatus according to claim 1, wherein the first board includes a voltage step-up circuit, the voltage step-up circuit is connected to the driving voltage generator via a second power supply line and feeds a stepped-up voltage to the driving voltage generator, the driving voltage generator generates the driving voltage based on an output voltage of the voltage step-up circuit, the sensing circuit unit is connected to the second power supply line and outputs a second sensing signal indicating whether or not a voltage on, and fed from, the second power supply line is equal to or lower than a second judgment value determined in advance, and the control circuit is fed with the second sensing signal and senses an abnormality in power supply from the first board to the second board based on the second sensing signal.

3. The inkjet recording apparatus according to claim 2, wherein a fuse is provided between the voltage step-up circuit and the driving voltage generator, on the first board, and a voltage between the fuse and the driving voltage generator is fed, as the voltage on the second power supply line, to the sensing circuit unit.

4. The inkjet recording apparatus according to claim 1, further comprising a heat sink attached to the driver circuit, wherein the driver circuit includes a temperature abnormality sensing circuit, the temperature abnormality sensing circuit outputs a temperature abnormality sensing signal and sets a level of the temperature abnormality sensing signal at a level indicating a temperature abnormality when a temperature of the driver circuit is judged to be equal to or higher than a reference temperature, and the control circuit is fed with the temperature abnormality sensing signal and senses an abnormality in the driver circuit based on the level of the temperature abnormality sensing signal.

5. The inkjet recording apparatus according to claim 4, further comprising a reference voltage generator that generates a second reference voltage based on an instruction from the control circuit, wherein the reference voltage generator feeds the generated second reference voltage to the temperature abnormality sensing circuit, the temperature abnormality sensing circuit sets the level of the temperature abnormality sensing signal at the level indicating a temperature abnormality when the temperature of the driver circuit is judged to be equal to or higher than the reference temperature, which is determined based on a magnitude of the second reference voltage, the control circuit keeps the second reference voltage at a first voltage value during an abnormality sensing period determined in advance, keeps the second reference voltage at a second voltage value outside the abnormality sensing period, judges that the temperature abnormality sensing circuit is normal if, when the second reference voltage is at the first voltage value, the level of the temperature abnormality sensing signal turns to the level indicating a temperature abnormality, and judges that the temperature abnormality sensing circuit is abnormal if, even when the second reference voltage is set at the first voltage value, the level of the temperature abnormality sensing signal does not turn to the level indicating a temperature abnormality, and the first voltage value is a voltage such that the reference temperature that is determined based on the first voltage value is lower than the reference temperature that is determined based on the second voltage value.

6. The inkjet recording apparatus according to claim 1, further comprising a reference voltage generator that generates a first reference voltage based on an instruction from the control circuit, wherein the driving voltage generator is fed with the first reference voltage and changes a magnitude of the generated driving voltage in accordance with a magnitude of the first reference voltage.

7. The inkjet recording apparatus according to claim 6, wherein the head includes a head sensor that senses a temperature of the head, an output of the head sensor is fed to the control circuit, and the control circuit senses the temperature of the head based on the output of the head sensor, changes the magnitude of the first reference voltage in accordance with the temperature of the head, decreases the driving voltage as the temperature of the head becomes higher, and increases the driving voltage as the temperature of the head becomes lower.

8. The inkjet recording apparatus according to claim 1, comprising a plurality of the heads and a plurality of the second boards, wherein the control circuit senses an abnormality in power supply on the second boards for each of the second boards individually.

9. The inkjet recording apparatus according to claim 1, further comprising a display panel, wherein when an abnormality is sensed, the control circuit makes the display panel notify of the abnormality.

10. A method for controlling an inkjet recording apparatus, comprising:

providing the inkjet recording apparatus with a head, a first board, and a second board;

providing the head with a plurality of nozzles that eject ink and a plurality of driving elements that make the nozzles eject the ink;

providing the first board with a control circuit and a sensing circuit unit;

providing the second board with a driving voltage generator and a driver circuit;

applying a driving voltage to the driving elements and thereby controlling ejection of the ink from the nozzles by using the driver circuit;

generating the driving voltage by using the driving voltage generator;

connecting the driving voltage generator to the driver circuit via a first power supply line;

feeding the generated driving voltage to the driver circuit;

connecting the sensing circuit unit to the first power supply line;

making the sensing circuit unit output a first sensing signal indicating whether or not a voltage on, and fed from, the first power supply line is equal to or lower than a first judgment value determined in advance; and sensing an abnormality in power supply on the second board based on the first sensing signal.

* * * * *